US008262211B2

(12) United States Patent
Yamagishi et al.

(10) Patent No.: US 8,262,211 B2
(45) Date of Patent: Sep. 11, 2012

(54) INK-JET PRINTER

(75) Inventors: Ryota Yamagishi, Ibaraki-ken (JP); Tomohiko Shimoda, Ibaraki-ken (JP); Naoki Akihiro, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 125 days.

(21) Appl. No.: 12/977,366

(22) Filed: Dec. 23, 2010

(65) Prior Publication Data

US 2011/0242220 A1 Oct. 6, 2011

(30) Foreign Application Priority Data

Apr. 1, 2010 (JP) ..... P2010-085405
Oct. 27, 2010 (JP) ..... P2010-240993

(51) Int. Cl.
*B41J 2/01* (2006.01)

(52) U.S. Cl. ..... 347/101; 347/220

(58) Field of Classification Search ..... 347/16, 347/40, 47, 101, 105, 154, 187, 220
See application file for complete search history.

(56) References Cited

U.S. PATENT DOCUMENTS 8,147,035 B2 * 4/2012 Hosono et al. ..... 347/47

FOREIGN PATENT DOCUMENTS

JP 2007-031007 A 2/2007

* cited by examiner

*Primary Examiner* — Thinh Nguyen
(74) *Attorney, Agent, or Firm* — Nath, Goldberg & Meyer; Jerald L. Meyer; Robert T. Burns

(57) ABSTRACT

An ink-jet printer comprises: a platen plate including a plurality of recesses, which are formed and regularly arranged in a front surface by digging from the front surface toward the back surface, and a suction hole extending from a part of the bottom surface of the recess through the back surface; and a print head having ink-discharging nozzles arranged in a nozzle face which is arranged in a position facing the front surface of the platen plate. The ink-discharging nozzles are arranged between an opening end of the recess and an opening end of the suction hole excluding an area directly above the suction hole of the platen plate.

11 Claims, 13 Drawing Sheets

INK-JET PRINTER

BACKGROUND OF THE INVENTION

1. Field of the Invention

The present invention relates to ink-jet printers, and in particular relates to an ink-jet printer for printing by discharging ink from a print head onto a recording medium which is stuck and transported in an image formation section.

2. Description of Related Art

Low price ink-jet printers capable of high-speed color printing have become remarkably popular. The ink-jet printer is coupled to a terminal of a personal computer or the like, acquires image data, such as a text, an illustration, and a symbol, prepared in this terminal, and prints this data onto a paper. Moreover, a complex ink-jet printer integrated with a scanner or a facsimile can print the image data acquired from a scanner unit or can print the image data transferred by the facsimile.

This type of ink-jet printer includes a mechanism for transporting a recording paper while sticking the same onto a platen plate in a position facing a print head of an image formation section. The recording paper is transported by a transport belt which slides on the platen plate, and is stuck to the platen plate via this transport belt using a suction force. By providing such a mechanism, in the image formation section the wrinkles or corrugations (cockling) of a recording paper can be prevented and also the curling of a recording paper can be prevented, and therefore the floating of a recording paper can be eliminated. As a result, the interference (e.g., recording-paper jam) between a recording paper and a print head can be prevented, and a distance (head gap) between a print head and a recording paper can be stably secured. Accordingly, a stable print and print image quality can be obtained.

In order to obtain a more stable print and print image quality, the suction force of a recording paper may be increased. However, with an increase of the suction force in the vicinity of a print head, air flow becomes fast and this air flow affects the orbit of an ink drop discharged from the print head, resulting in degradation in the print image quality. Moreover, as the air flow becomes fast, mist is likely to be induced from an ink drop and this mist results in dirt on a recording paper and results in contamination inside the ink-jet printer (contamination inside the device).

Japanese Patent Application Laid-open Publication No. 2007-31007 discloses a paper transport mechanism which is used in an ink-jet printer, includes an air flow control unit for controlling so as to reduce the air flow in a paper transport direction which occurs in the vicinity of an area directly under an ink-jet head, and can suppress the occurrence of the above-described ink mist. As the air flow control unit of this paper transport mechanism, an example of plugging an air flow hole on a platen, an example of reducing the formation density of air flow holes, and an example of reducing the diameter of the air flow hole are disclosed. By providing this air flow control unit, the paper contamination due to the ink mist generated in an end part of a paper can be prevented.

SUMMARY OF THE INVENTION

However, in the paper transport mechanism disclosed in the above-described patent document, an air flow on the downstream side in the paper transport direction, the air flow being generated in the vicinity of an area directly under an ink-jet head, can be reduced. However, the air flow hole is not arranged in the area directly under an ink-discharging nozzle of the ink-jet head, the area having the highest influence on the print image quality, and the floating of a paper occurring in this area has not been taken into consideration. If the floating of a paper occurs directly under this ink-discharging nozzle, it is difficult to secure a head gap between the ink-discharging nozzle and a paper transported to an area directly thereunder, and the paper may contact the ink-discharging nozzle. Hence, there is a concern about the degradation in the print image quality.

The present invention has been made to solve the above-described problems. It is an object of the present invention to provide an ink-jet printer capable of preventing the floating of a recording medium directly under an ink-discharging nozzle while reducing the air flow associated with the suction of the recording medium in an area directly under the ink-discharging nozzle of a print head and in the vicinity of this area, suppressing the generation of the mist of an ink drop, and preventing the contamination of the recording medium or the contamination inside the device. It is another object of the present invention to provide an ink-jet printer capable of preventing the interference between a print head and a recording medium and suppressing degradation in the print image quality.

According to a main characteristic of an embodiment of the present invention, an ink-jet printer comprises: a platen plate including a plurality of suction holes extending from a front surface through a back surface and a recess which is opened toward the front surface around each suction hole; and a plurality of print heads each having an ink-discharging nozzle provided in a nozzle face which is arranged in a position facing the front surface of the platen plate, wherein the ink-discharging nozzle of each of the print heads is arranged in an area overlapping with some of the recesses of the platen plate.

DESCRIPTION OF EMBODIMENTS

Figure 1:
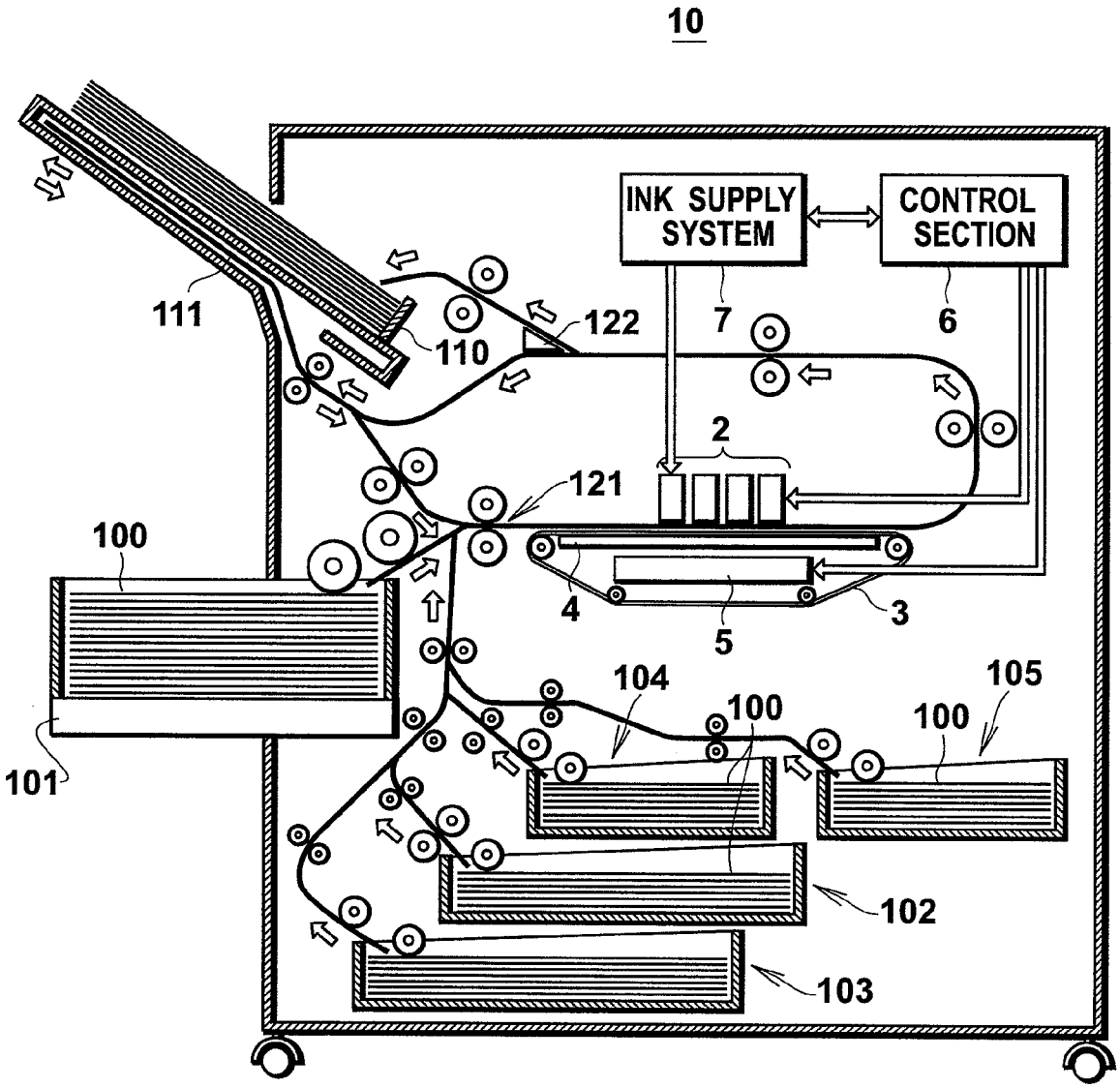
FIG. 1 is a schematic configuration diagram of an ink-jet printer according to Embodiment 1.

Next, embodiments of the present invention will be described with reference to the accompanying drawings. In the following description of the drawings, the same or similar reference numeral is attached to the same or similar member. However, the drawings are schematically shown and differ from the real ones.

Moreover, the embodiments shown below exemplify devices or methods for embodying technical ideas of the present invention, and the technical ideas of the present invention are not to be construed as limiting the arrangement and the like of the respective components to the following embodiments. The technical ideas of the present invention may be modified within the scope of the claims.

[Embodiment 1]

Embodiment 1 of the present invention is an example of applying the present invention to a color ink-jet printer for printing using a cyan ink, a magenta ink, a yellow ink, and a black ink. Note that, the present invention is not necessarily applied to only the color ink-jet printer, but can be applied also to a monochrome (including gray scale) ink-jet printer.

Device Configuration of Ink-jet Printer

As shown in FIG. 1, an ink-jet printer 10 according to Embodiment 1 includes a transport mechanism for feeding a recording medium 100 to be printed, printing on the recording medium 100, and ejecting the printed recording medium 100. In the ink-jet printer 10, in the left side-face of a housing without a reference numeral attached, a detachable paper feed stand 101 projecting outward from this housing is arranged, and a plurality of paper feed trays 102, 103, 104, and 105 is arranged inside the housing. An unprinted recording medium 100 (recording medium 100 before printing) is stored in these paper feed stand 101 and paper feed trays 102 to 105. Moreover, a paper ejection tray 110 is arranged in the left upper part of the housing of the ink-jet printer 10. The printed recording medium (recording medium after printing) 100 is ejected to the paper ejection tray 110. Here, as the recording medium 100, a recording paper is used. Moreover, the recording medium 100 is not limited to this recording paper, and may be a paper coated with a recording film, an OHP film (OHP sheet) used in an overhead projector (OHP), a disc made of resin, or the like.

The ink-jet printer 10 includes a plurality of ink-jet print heads 2 having a large number of ink-discharging nozzles (represented by reference numerals 21, 22 in FIG. 2, FIG. 3, and FIG. 5) arranged in a direction intersecting with (here, the direction perpendicular to) the transport direction of the recording medium 100 which is fed from the paper feed stand 101 or the like. These print heads 2 are coupled to an ink supply system 7. The ink supply system 7 is coupled to a control section 6, and the operations of the ink supply system 7 and print head 2 are controlled by the control section 6. The respective print heads 2 discharge a black ink, a cyan ink, a magenta ink, and a yellow ink to print in the unit of one line. That is, the ink-jet printer 10 according to Embodiment 1 is a color ink-jet printer employing a line print method.

In an image formation section of the ink-jet printer 10, a platen plate 4 is arranged via a transport belt 3 in a position facing the print head 2 (on the lower side in FIG. 1). The transport belt 3 is a cyclic belt without termination, slides (travels) on the platen plate 4, transports (feeds) the recording medium 100 onto the platen plate 4, and transports (ejects) the recording medium 100 from the platen plate 4 after printing. Note that the detailed configurations of the transport belt 3 and platen plate 4 will be described later.

A suction device 5 is arranged under the platen plate 4, i.e., on the opposite side of the print head 2 (on the lower side in FIG. 1). The suction device 5 has a function to cause the recording medium 100, which is transported to the image formation section and printed, to stick to the platen plate 4 via the transport belt 3. In Embodiment 1, an air suction fan is used in the suction device 5. Moreover, in Embodiment 1, although the suction device 5 is built in the housing of the ink-jet printer 10, it may be installed as an external device outside the housing of the ink-jet printer 10 and be piped to the platen plate 5 using a suction duct. The suction device 5 is coupled to the control section 6, and the operation of the suction device 5 is controlled by the control section 6.

Note that the ink-jet printer 10 according to Embodiment 1 is not limited only to the ink-jet printer using the method of printing in the unit of one line, but may be applied to a serial ink-jet printer using the method of printing while scanning in the line direction.

Print Operation of Ink-jet Printer

The print operation of the ink-jet printer 10 shown in FIG. 1 is as follows. First, the unprinted recording medium 100 fed from any of the paper feed stand 101 and paper feed trays 102-105 is transported along a transport path of the paper feed system inside the housing by a drive mechanism (with no specific reference numeral attached) which is constructed from a roller and the like, and is then introduced to a resist section 121. The resist section 121 has a function to perform the alignment of a front end in the supply direction of the transported recording medium 100, the correction of skews, and the like. The resist section 121 includes a pair of resist rollers arranged in a direction perpendicular to the transport path of the paper feed system. The recording medium 100 transported to the resist section 121 is stopped here once, and thereafter transported, at a predetermined timing, in the direction of the image formation section (printing section) in which the print head 2 is arranged.

The circular transport belt 3 is arranged in an area facing the print head 2 via the transport path of the paper feed system and transports the recording medium 100 at a speed determined by a print condition. The print head 2 discharges each color ink onto the recording medium 100 which is transported onto the platen plate 4 using the transport belt 3, and thus color printing, monochrome printing, or gray scale printing is performed.

The printed recording medium 100 is transported along a transport path of a paper ejection system by the drive mechanism, and in the case of single-sided print, the printed recording medium 100 is introduced to the paper ejection tray 110 as it is, and is ejected. Moreover, in the case of double-sided print, the single-sided printed recording medium 100 is introduced to a switchback path 111 through a switching mechanism 122 from the transport path of the paper ejection system, and the recording medium 100 inverts its print face and is again returned to the transport path of the paper feed system. As with the case of the single-sided print, the recording medium 100 having been returned to the transport path of the paper feed system is transported from the resist section 121 to the image formation section, and is printed here and thereafter ejected to the paper ejection tray 110 through the transport path of the paper ejection system.

Configuration of Image Formation Section

In the image formation section of the ink-jet printer 10 according to Embodiment 1, the platen plate 4 includes: a plurality of recesses 41, which are formed and regularly arranged in a front surface by digging from the front surface toward a back surface facing thereto; and a suction hole 42 extending from a part of the bottom surface of the recess 41 through the back surface, as shown in FIG. 2, FIG. 3, FIG. 4, FIG. 5, FIG. 6A, and FIG. 6B. In other words, the platen plate 4 includes: a plurality of suction holes 42 extending from the front surface through the back surface; and a recess 41 opened toward the front surface around each suction hole 42. Here, the front surface of the platen plate 4 refers to the upper surface in FIG. 2 and FIG. 3 and the front surface on the print head 2 side. The back surface of the platen plate 4 refers to the lower surface in FIG. 1 and FIG. 2 and the front surface on the suction device 5 side.

Figure 6A:
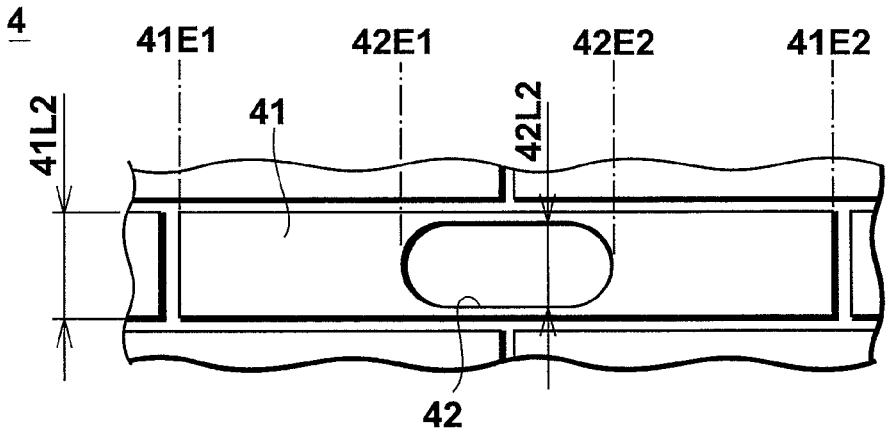
FIG. 6A is a further enlarged plan view of the main part of the image formation section shown in FIG. 4.
Figure 6B:
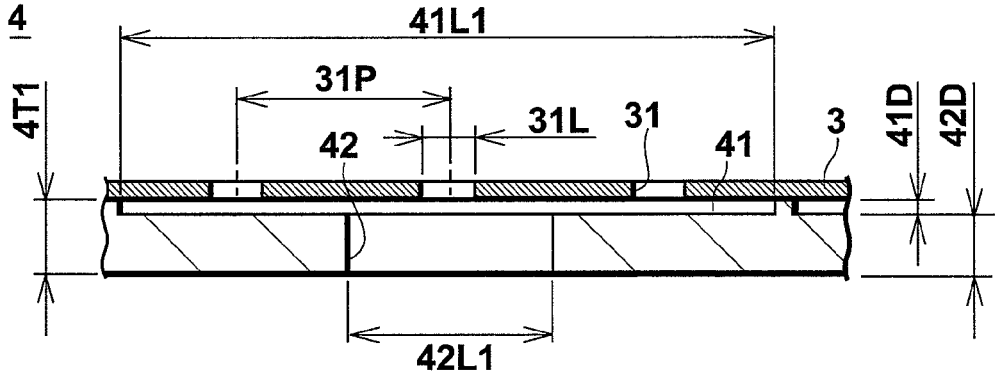
FIG. 6B is a cross sectional view of the main part of the image formation section shown in FIG. 6A.

The platen plate 4 is a plate made of metal or resin, for example. Thickness 4T1 of the platen plate 4 shown in FIG. 6B is set to 2.5 mm to 7.0 mm, for example.

The planar shape (opening shape) of the recess 41 arranged in the front surface of the platen plate 4 is formed into a rectangular shape which is elongated along the transport direction of the recording medium 100, here. Length 41L1 in the transport direction of the recess 41 shown in FIG. 6B is set to 16 mm to 68 mm, for example. The length (groove length) 41L1 of the recess 41 is set to a distance between the print heads 2 arranged in the transport direction (direction from the left toward right in this view) shown in FIG. 4 and FIG. 5 or to a multiple of the distance. Length (groove width) 41L2 in a direction intersecting with the transport direction of the recess 41 shown in FIG. 6A is set to 4 mm to 10 mm, for example. Depth (groove depth) 41D of the recess 41 shown in FIG. 6B is set to 0.5 mm to 2.0 mm, for example, which is smaller than the thickness 4T1 of the platen plate 4 by approximately ⅓.5 to ¼. Here, in FIG. 4 and FIG. 5, the left side in the transport direction about the print head 2 is the side from which the unprinted recording medium 100 is fed, and is the upstream side in the transport direction. The right side in the transport direction about the print head 2 is the side to which the printed recording medium 100 is ejected, and is the downstream side in the transport direction.

Figure 4:
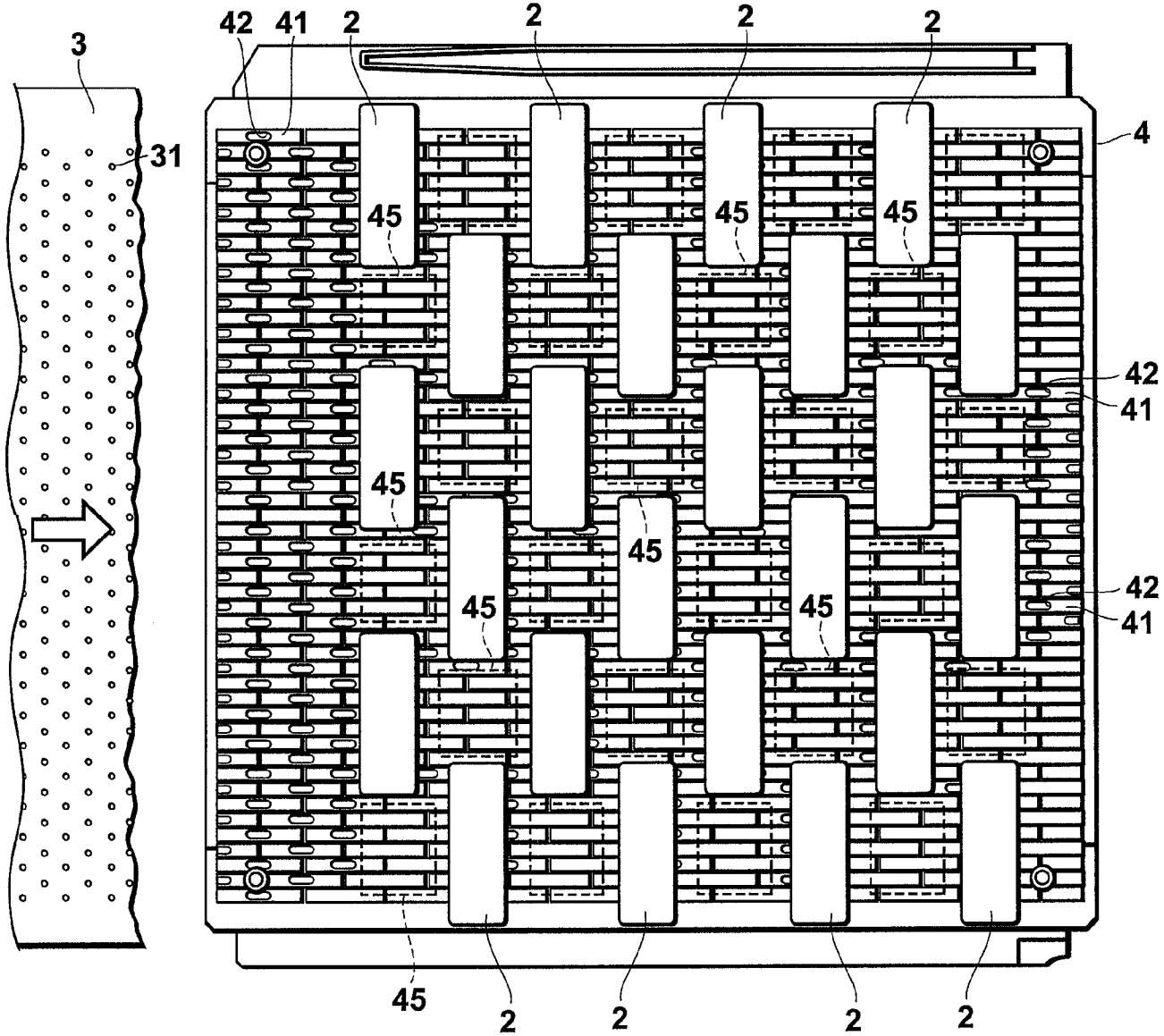
FIG. 4 is a plan view of the image formation section of the ink-jet printer shown in FIG. 2.
Figure 5:
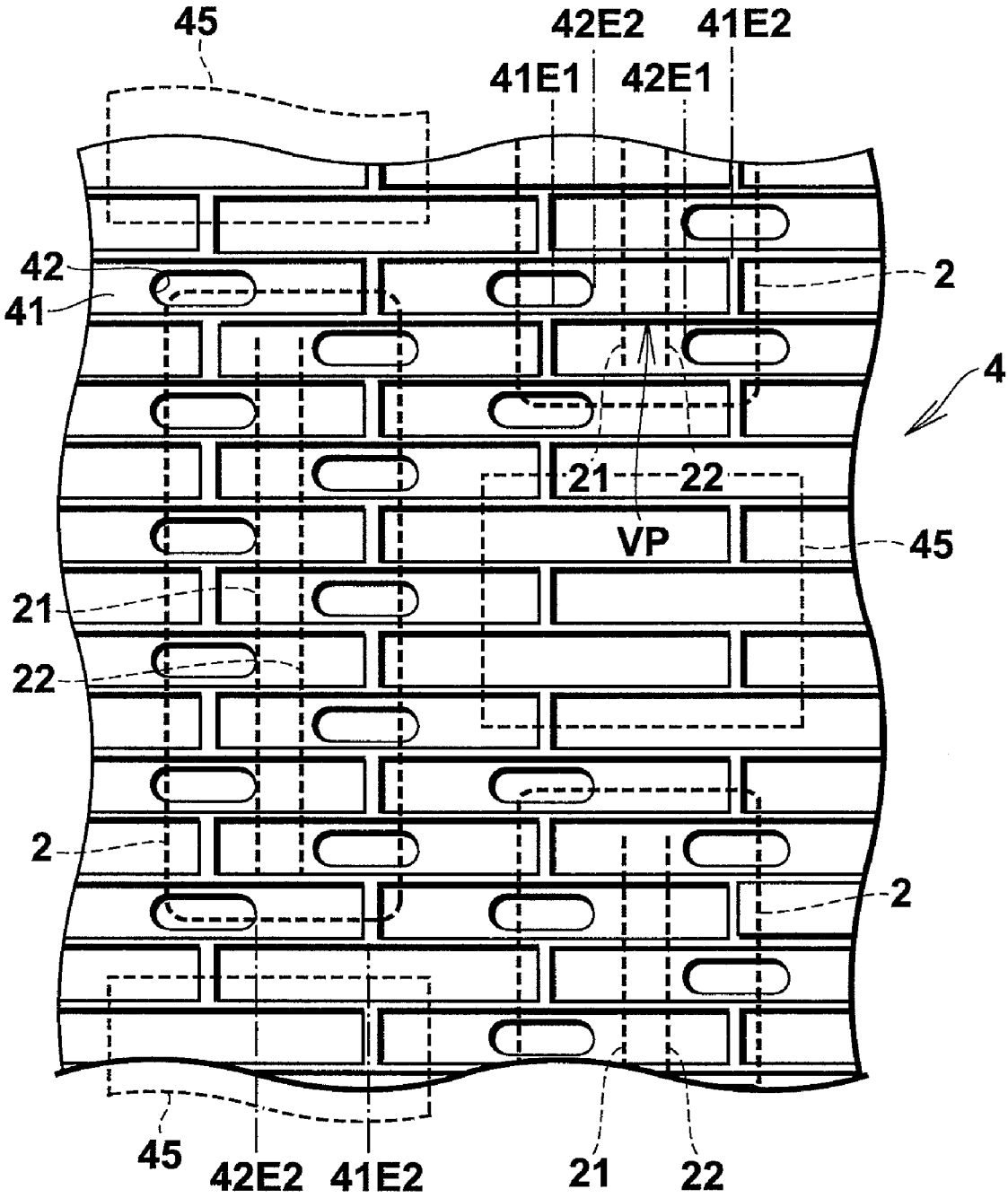
FIG. 5 is an enlarged plan view of the main part of the image formation section shown in FIG. 4.

As shown in FIG. 4 and FIG. 5, the recess 41 is regularly arranged at a constant pitch in the transport direction, and the recess 41 in the next stage adjacent in the direction intersecting with (perpendicular to) the transport direction shifts by a half pitch with respect to the preceding stage pitch, and is regularly arranged at the same constant pitch in the transport direction. That is, the recess 41 is arranged in a staggered pattern in the front surface of the platen plate 4.

The suction hole 42 is arranged in the center part (a part) of the dug bottom surface of the recess 41, and the suction hole 42 is continuously connected to the suction device 5 arranged under the platen plate 4. The planar shape (opening shape) of the suction hole 42 is formed into an oval shape which is elongated in the transport direction and has an arc shape at both ends in the transport direction, here. Length 42L1 of the suction hole 42 in the transport direction shown in FIG. 6B is set to 4 mm to 30 mm, for example, which is shorter than the length 41L1 of the recess 41. Length 42L2 of the recess 42 in the direction intersecting with the transport direction shown in FIG. 6A is set to 3 mm to 8 mm, for example, which is shorter than the length 41L2 of the recess 41. Depth 42D of the suction hole 42 shown in FIG. 6B is set to 2 mm to 5 mm, for example, occupying most of the thickness 4T1 of the platen plate 4.

In Embodiment 1, the suction hole 42 is arranged in not all of the recesses 41, but as shown in FIG. 4, is intensively arranged in an area immediately before an area where the recording medium 100 having been transported to the image formation section enters a print head group comprising a plurality of print heads 2 arranged, and also under each print head 2. If an expansion occurs in the peripheral length of the recording medium 100 (e.g., a recording paper) with moisture absorption, temperature increase, or the like, the recording paper will locally float. Even if attempting to forcibly press the whole area of such a recording paper, the recording paper will always partially float. In order to prevent the interference between the print head 2 and the recording paper and secure a stable head gap, it is necessary to densely arrange the suction holes 42 in an area immediately before an area where the recoding paper enters the print head group or in an area under each print head 2 (area overlapping with the print head 2), and to cause this area to function as a suction area and forcibly suck the recording paper to the platen plate 4. The area other than the above-described area is a non-suction area 45 functioning as a clearance area for the floating, the clearance area intentionally allowing for the floating of the recording paper. The non-suction area 45 is arranged between the print heads 2 arranged in the direction intersecting with the transport direction. The non-suction area 45, as described above, may function to allow for the floating of the recording paper and function as the clearance of the floating. Therefore, in order to reduce the suction force of the recording paper, the arrangement density of the suction hole 42 may be smaller than that of the suction hole 42 in the area overlapping with the print head 2. That is, the number of suction holes 42 arranged per unit area in the non-suction area 45 may be smaller than the number of suction holes 42 arranged per unit area in the area overlapping with the print head 2. In Embodiment 1, the number of suction holes 42 arranged in the non-suction area 45 is set to zero.

Moreover, by arranging the suction hole 42 only in the area (area under the print head 2), in which the suction hole 42 is needed, without arranging the suction hole 42 in the area (non-suction area 45) in which the suction hole is not needed in particular, the opening portion can be reduced and the suction efficiency can be improved as compared with the case where the suction holes 42 are secured across the whole platen plate 4. Improvement of the suction efficiency can increase the suction force of the recording paper and achieve the miniaturization of the suction device 5.

Because the recess 41 and suction hole 42 are arranged in a staggered pattern in the platen plate 4, the suction holes 42 can be arranged with no space therebetween and the recording medium 100 can be uniformly and reliably sucked across the whole area. If the suction holes 42 are arranged in a matrix pattern instead of a staggered pattern in the transport direction of the recording medium 100 and the direction perpendicular thereto, then an area which does not suck the recording medium 100 is produced between the adjacent suction holes 42 in the transport direction and the direction intersecting therewith, the effect of sucking the recording medium 100 decreases, and a floating will occur in the recording medium 100 corresponding to the area which does not suck the recording medium 100.

The transport belt 3 comprises a material, such as rubber or resin, having plasticity and generating an appropriate functional force against the recording medium 100. A punch hole 31 is arranged in the transport belt 3, as shown in FIG. 2, FIG.

Figure 3:
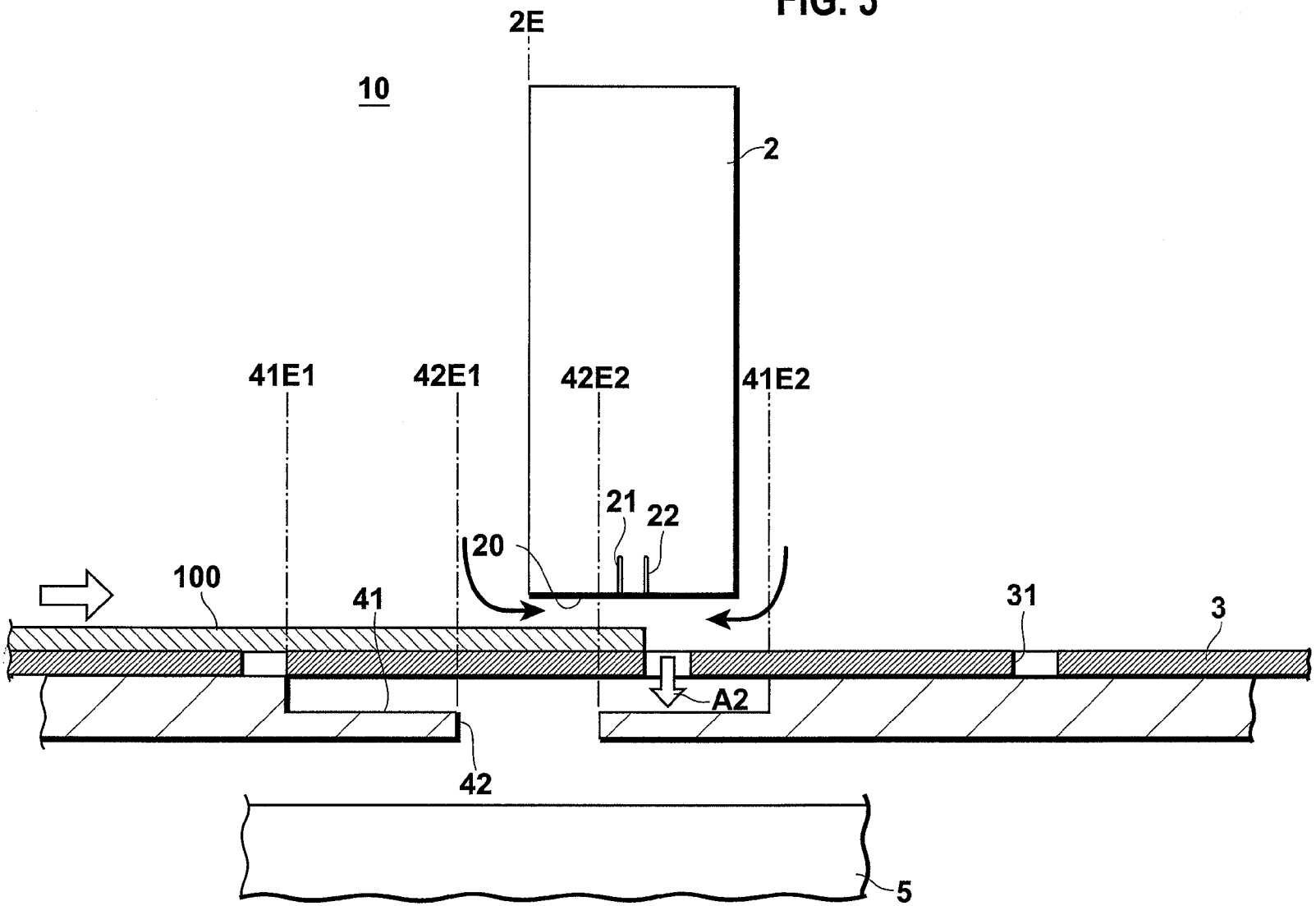
FIG. 3 is an enlarged sectional view of the main part of the image formation section of the ink-jet printer shown in FIG. 2.

3, FIG. 4, and FIG. 6B, so that the recording medium 100 can be stuck to the front surface of the transport belt 3 by an air flow of a negative pressure flowing into the suction device 5 through the punch hole 31 (i.e., by a suction force). The planar shape of the punch hole 31 of the transport belt 3 is formed into a circular shape, for example, and the diameter 31L of the punch hole 31 shown in FIG. 6B is set to 1 mm to 3 mm, for example. Pitch 31P of the punch hole 31 in the transport direction is set smaller than the pitch of the recess 41 of the platen plate 4 in the same direction, and is set to 6 mm to 18 mm, for example. The pitch of the punch hole 31 in the direction intersecting with the transport direction is set equal to the pitch of the recess 41 in the same direction, as shown in FIG. 3. Furthermore, with respect to the arrangement pitch of the punch hole 31 in the transport direction, the arrangement pitch, in the transport direction, of the punch hole 31 in the next stage adjacent in the direction intersecting with the transport direction shifts by a half pitch from the preceding stage. That is, the punch hole 31 is arranged in a staggered pattern as with the arrangement of the recess 41 of the platen plate 4.

Figure 2:
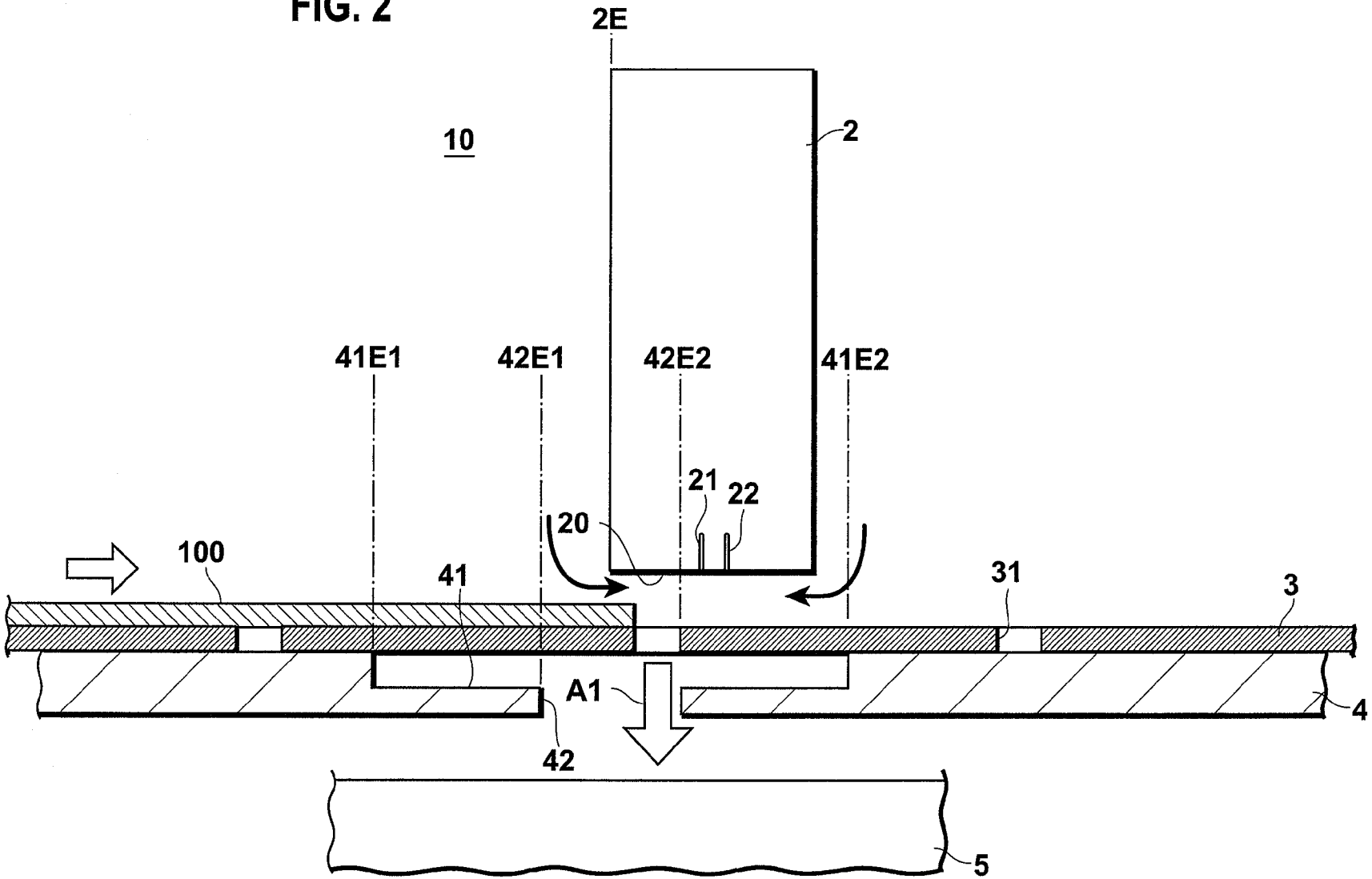
FIG. 2 is an enlarged sectional view of a main part of an image formation section of the ink-jet printer according to Embodiment 1 of the present invention.

As shown in FIG. 2 and FIG. 3, the print head 2 has a nozzle face 20 facing the front surface of the platen plate 4 and creating a head gap, and the ink-discharging nozzles 21 and 22 are arranged in the nozzle face 20. In Embodiment 1, in the nozzle face 20 of one print head 2, two rows of ink-discharging nozzles 21 and 22 are arranged in the transport direction, wherein each of the ink-discharging nozzles 21 and 22 has a plurality of nozzles arranged at a certain interval in the direction intersecting with the transport direction.

As shown in FIG. 2, FIG. 3, and FIG. 5, the ink-discharging nozzles 21 and 22 of the print head 2 are arranged between an opening end (first opening end) 41E2 of the recess 41 and an opening end (second opening end) 42E2 of the suction hole 42, excluding in the area directly above the suction hole 42 of the platen plate 4. FIG. 2 illustrates a state where the punch hole 31 of the transport belt 3 is present in an area directly above the suction hole 42 of the platen plate 4 (i.e., in the area overlapping with the suction hole 42). At this time, the suction hole 42 is directly connected to the punch hole 31, and the first suction passage extending from the front surface of the platen plate 4 through the back surface is produced, and the suction force from the suction device 5 becomes strong in the first suction passage, and therefore the flow of air A1 into the suction device 5 through the punch hole 31 and suction hole 42 becomes fast and the flow rate increases (the air volume increases).

FIG. 3 illustrates a state where the punch hole 31 of the transport belt 3 is present in an area overlapping with the recess 41, excluding the area directly above the suction hole 42 of the platen plate 4. At this time, the suction hole 42 is indirectly connected to the punch hole 31 through a flow path formed by the recess 41 and the transport belt 3, so that a second suction passage is formed which extends from the front surface of the platen plate 4 through a flow path formed by the recess 41 and the suction hole 42. Since the suction force from the suction device 5 becomes weak in the second suction passage, the flow of air A2 into the suction device 5 through the punch hole 31, recess 41, and suction hole 42 is slow and the flow rate decreases (air volume decreases).

Figure 6C:
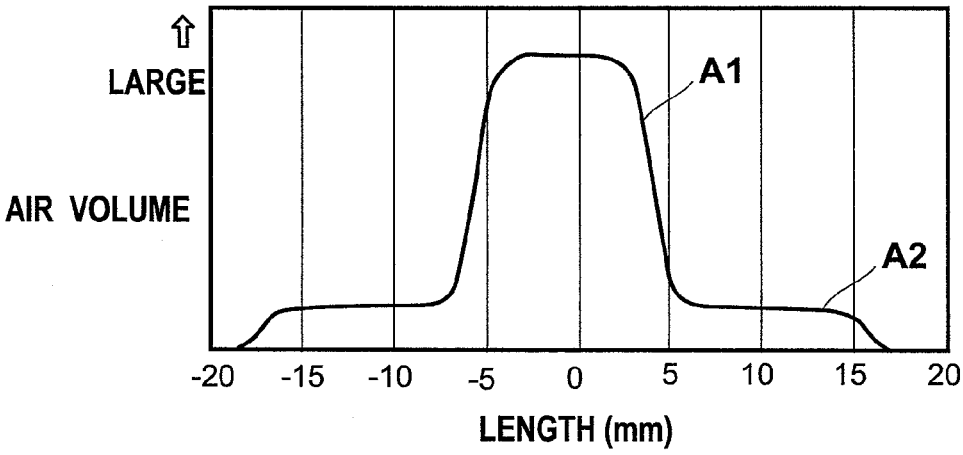
FIG. 6C is an air volume distribution chart.

FIG. 6C illustrates a result of measuring the air volume in the punch hole 31 of the transport belt 3. The horizontal axis of FIG. 6C represents the length (mm), and corresponds to the arrangement positions of the recess 41 and suction hole 42 of the platen plate 4 shown in FIG. 6A and FIG. 6B. The vertical axis represents the air volume. As apparent from FIG. 6C, in the state shown in FIG. 2, i.e., when the first suction passage functions, the flow velocity of air is fast and the suction force increases. In the state shown in FIG. 3, i.e., when the second suction passage functions, the suction force is reliably secured although the flow velocity of air becomes slow and the suction force becomes weak.

In the ink-jet printer 10 according to Embodiment 1, the ink-discharging nozzles 21 and 22 of the print head 2 are arranged in an area directly above the second suction passage, in which the suction force is weak and the air flow is slow but the suction of the recording medium 100 can be reliably performed, avoiding the area directly above the first suction passage in which the suction force is strong and the air flow is fast. Although the suction force of this portion is weak, in the area directly under the ink-discharging nozzles 21 and 22 the recording medium 100 can be reliably stuck to the platen plate 4 side. Therefore, the floating of the recording medium 100 can be prevented and a stable head gap can be secured. In addition to this (compatible with this), the suction force is weak, the air flow is slow, and the flow rate is low, and therefore, there is no influence on the locus of an ink drop discharged from the ink-discharging nozzles 21 and 22, and furthermore the occurrence of the mist from an ink drop can be reduced. As a result, in particular the interference between the ink-discharging nozzles 21 and 22 and the recording medium 100 in the print head 2 can be prevented. Moreover, since a stable head gap can be secured and the occurrence of the mist can be reduced without influencing the locus of an ink drop, the print image quality can be improved.

Furthermore, in the ink-jet printer 10 according to Embodiment 1, in the area directly above the first suction passage (i.e., in the area overlapping with the suction hole 42), a part 2E around the nozzle face 20 of the print head 2 on the most upstream side in the transport direction is arranged in order to effectively use the strong suction force characteristic. If the suction force of this part is strong, the recording medium 100, which is transported by the transport belt 3, can be reliably stuck to the platen plate 4 side immediately before the recording medium 100 is pulled in the nozzle face 20 of the print head 2. Therefore, the floating of the recording medium 100 can be prevented and a stable head gap can be secured.

In the ink-jet printer 10 according to Embodiment 1, as shown in FIG. 5, the ink-discharging nozzles 21 and 22 of the print head 2 are arranged between the opening end (first opening end) 41E2 of the recess 41 and the opening end (second opening end) 42E2 of the suction hole 42, excluding in the area directly above the suction hole 42 of the platen plate 4. At the same time, the ink-discharging nozzles 21 and 22 of the print head 2 are arranged between an opening end (third opening end) 41E1 of the recess 41 in the next stage and an opening end (fourth opening end) 42E1 of the suction hole 42 in the next stage, excluding in the area directly above the suction hole 42 in the next stage adjacent in the direction intersecting with the transport direction of the platen plate 4. Since the recess 41 and the suction hole 42 are arranged in a staggered pattern in the front surface of the platen plate 4, the ink-discharging nozzles 21 and 22 are always arranged in an area overlapping with the second suction passage in any position in the direction intersecting with the transport direction.

More specifically, a positional relationship between one row of ink-discharging nozzles 21 of two rows of ink-discharging nozzles of one print head 2 on the upper right side of FIG. 5 and one recess 41 and suction hole 42 overlapping with the one row of ink-discharging nozzles 21 is in a rotationally symmetric relationship with a positional relationship between the other one row of ink-discharging nozzles 22 of two rows of ink-discharging nozzles of the same print head 2 and one recess 41 and suction hole 42 in the next stage adjacent in the direction intersecting with the transport direction, the one recess 41 and suction hole 42 overlapping with the other ink-discharging nozzle 22 and shifting by a half pitch. That is, about a virtual point VP shown for convenience in the center between the ink-discharging nozzles 21 and 22 of one print head 2 and in the center between two recesses 41 adjacent to each other in the direction intersecting with the transport direction, the two recesses 41 shifting by a half pitch, the layout of one ink-discharging nozzle 21 and the recess 41 and suction hole 42 overlapping with the one ink-discharging nozzle 21 is 180-degree rotationally symmetric with the layout of the other ink-discharging nozzle 22 and the recess 41 and suction hole 42 in the next stage overlapping with the other ink-discharging nozzle 22.

As described above, the recess 41 and suction hole 42 of the platen plate 4 according to Embodiment 1 are arranged in a staggered pattern, so that the suction force across the whole area of the recording medium 100 is uniformly and reliably secured and the floating of the recording medium 100 is prevented. Hence, conversely, the air flow associated with an increase in the suction force becomes fast and the occurrence of the mist of an ink drop is likely to increase. In order to prevent this, if the layout as described using FIG. 5 is employed for the suction holes 42 arranged in a staggered pattern, then between the suction holes 42 arranged in a staggered pattern and in an area overlapping with the recess 41 excluding these suction holes 42, the ink-discharging nozzles 21 and 22 can be arranged, and the mist countermeasure can be reliably taken.

Features of Embodiment 1

As described above, in the ink-jet printer 10 according to Embodiment 1, the platen plate 4 of the image formation section includes the recess 41 and the suction hole 42, and the ink-discharging nozzles 21 and 22 of the print head 2 are arranged overlapping with the recess 41 (the second suction passage) except directly above the suction hole 42. Accordingly, the air flow associated with the suction of the recording medium 100 in the area directly under the ink-discharging nozzles 21 and 22 of the print head 2 and in the vicinity of this area can be reduced, and the floating of the recording medium 100 directly under the ink-discharging nozzles 21 and 22 can be prevented while suppressing the generation of the mist of an ink drop and preventing the contamination of the recording medium 100 or the contamination inside the device. As a result, directly under the ink-discharging nozzles 21 and 22, the interference between the ink-discharging nozzles 21 and 22 of the recording medium 100 can be prevented, and a stable head gap can be secured and additionally the air flow can be reduced. Therefore, there is no influence on the locus of an ink drop and the generation of the mist can be also reduced, and the print image quality can be dramatically improved.

Furthermore, in the ink-jet printer 10 according to Embodiment 1, the part 2E of the periphery of the nozzle face 20 of the print head 2 on the most upstream side in the transport direction is arranged overlapping with the suction hole 42 (the first suction passage) of the platen plate 4 of the image formation section. Accordingly, the floating of the recording medium 100 immediately before being transported to the nozzle face 20 of the print head 2 can be prevented by a strong suction force, and therefore, the interference between the print head 2 and the recording medium 100 can be prevented. As a result, the transport failure of the recording medium 100 can be dramatically improved. Moreover, since the recording medium 100 can be reliably stuck to the platen plate 4 and as a result a stable head gap can be secured, the print image quality can be improved.

Furthermore, in the ink-jet printer 10 according to Embodiment 1, the recess 41 and the suction hole 42 are arranged in a staggered pattern in the platen plate 4 of the image formation section, and the ink-discharging nozzles 21 and 22 are arranged between the adjacent suction holes 42 arranged in a staggered pattern. Accordingly, due to the staggered pattern arrangement of the suction holes 42, the recording medium 100 can be uniformly and reliably sucked and the floating of the recording medium 100 can be prevented, and at the same time, as described above, directly under the ink-discharging nozzles 21 and 22, the interference between the ink-discharging nozzles 21 and 22 of the recording medium 100 can be prevented, and a stable head gap can be secured. Additionally, because the air flow can be reduced, there is no influence on the locus of an ink drop and the generation of the mist can be also reduced, and the print image quality can be dramatically improved.

[Embodiment 2]

Embodiment 2 of the present invention is an example of modifying the shape of the print head 2 of the ink-jet printer 10 according to Embodiment 1.

Figure 7:
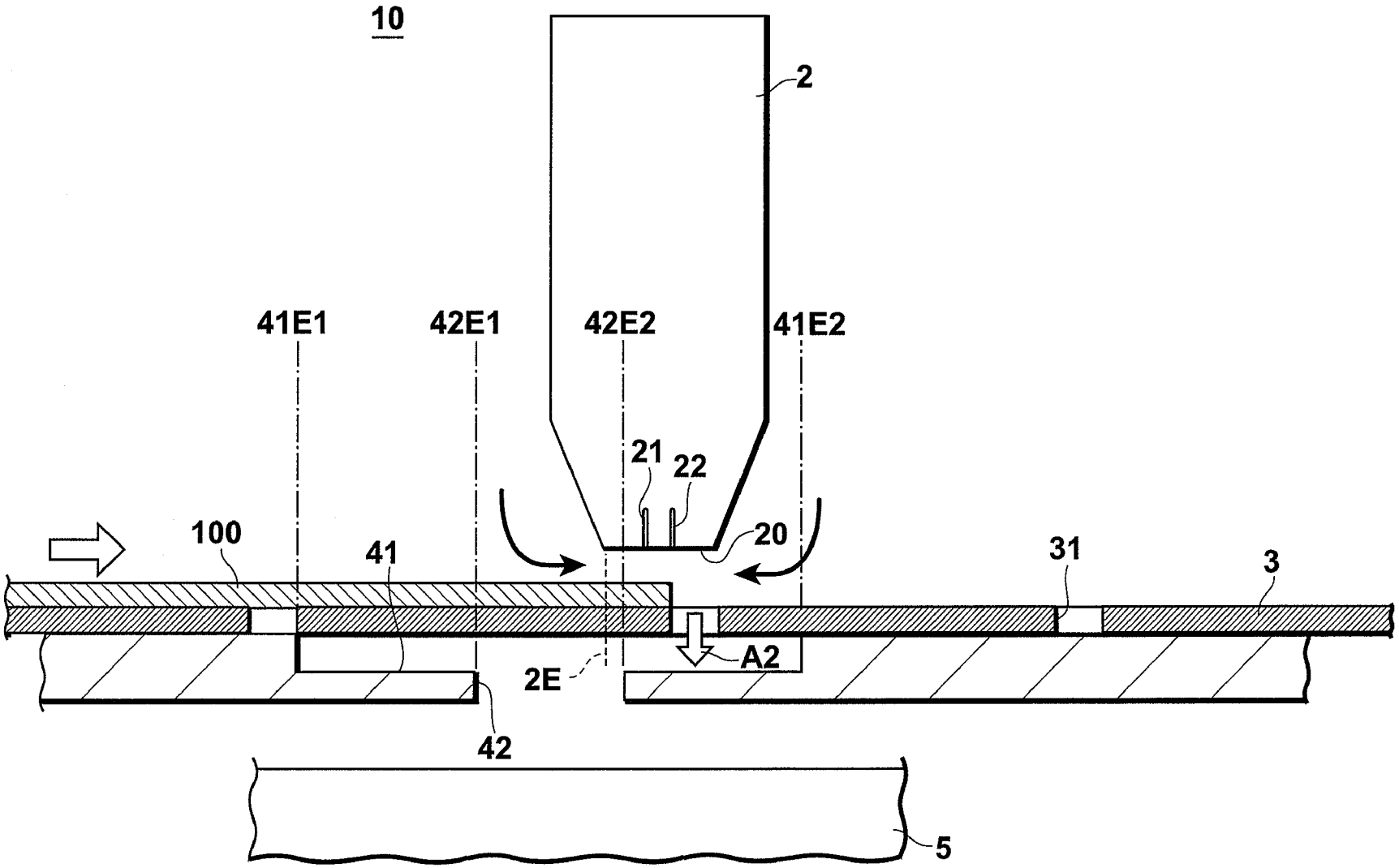
FIG. 7 is an enlarged sectional view of a main part of an image formation section of an ink-jet printer according to Embodiment 2 of the present invention.

The print head 2 arranged in the image formation section of the ink-jet printer 10 according to Embodiment 2 includes a cut portion (chamfered portion) between the nozzle face 20 and the side face as shown in FIG. 7. The effective nozzle face 20 is the portion facing in parallel to the front surface of the platen plate 4, and the part 2E of the periphery of the nozzle face 20 on the most upstream side in the transport direction is arranged in an area directly above the suction hole 42 (in the area overlapping with the first suction passage) as in the ink-jet printer 10 according to the above-described Embodiment 1.

In the ink-jet printer 10 according to Embodiment 2, the same operational effect as that obtained in the ink-jet printer 10 according to Embodiment 1 can be attained.

[Embodiment 3]

Embodiment 3 of the present invention is an example capable of further reducing the floating of the recording medium 100 before being transported to the print head 2, in the ink-jet printer 10 according to Embodiment 1.

Device Configuration of Ink-jet Printer

Figure 8:
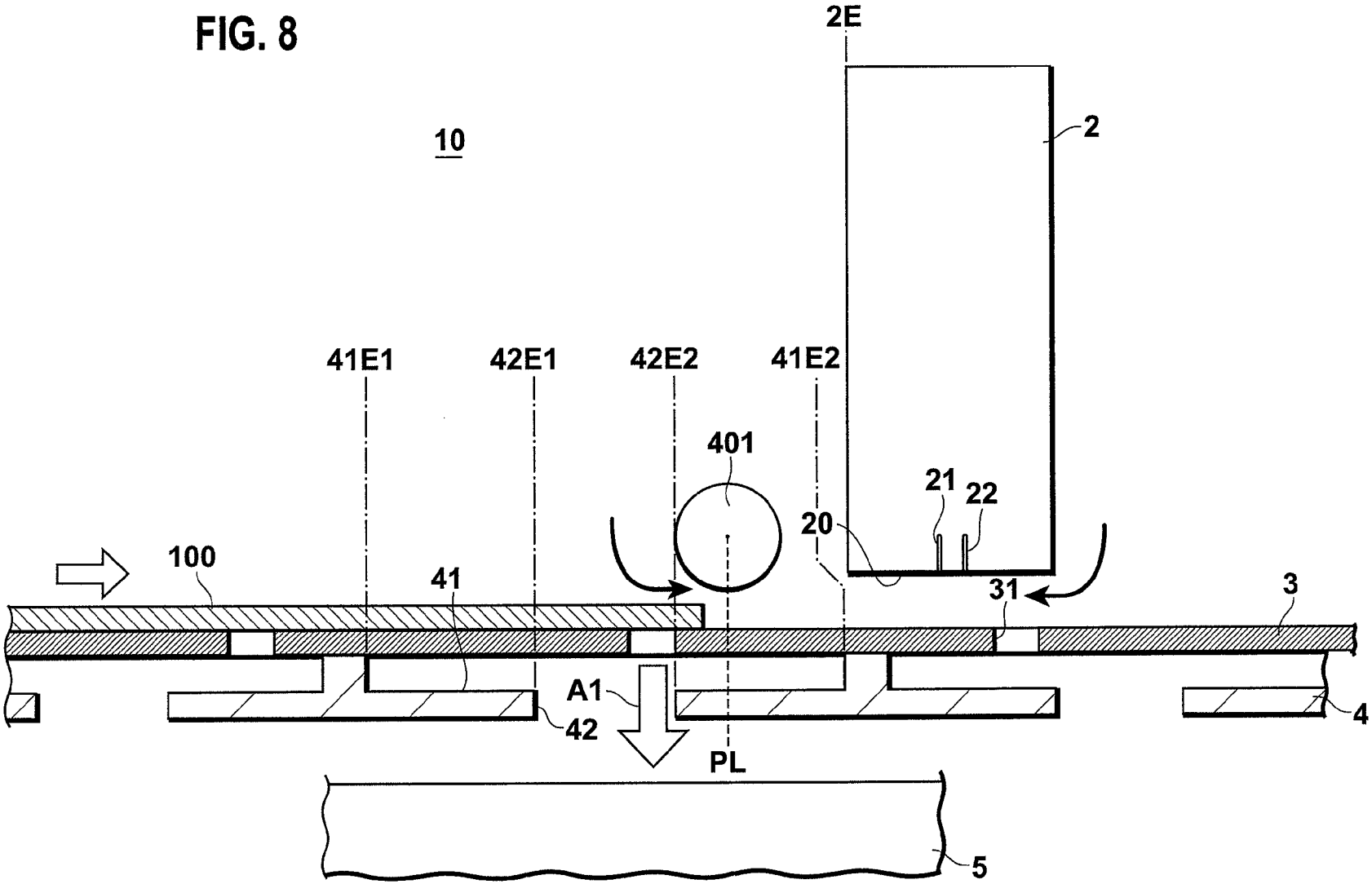
FIG. 8 is an enlarged sectional view of a main part of an image formation section of an ink-jet printer according to Embodiment 3 of the present invention.
Figure 9:
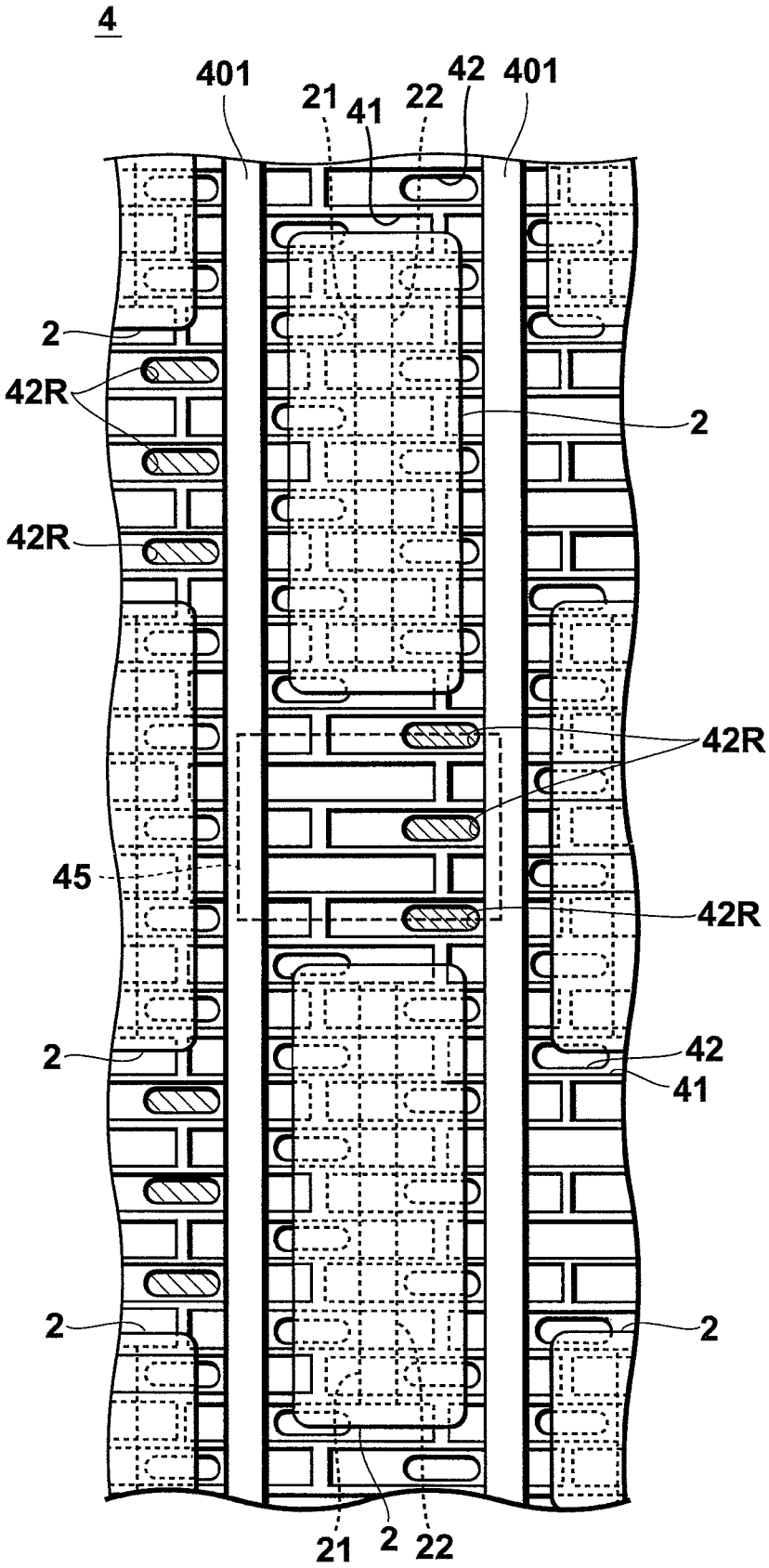
FIG. 9 is an enlarged plan view of the main part of the image formation section of the ink-jet printer shown in FIG. 8.

As shown in FIG. 8 and FIG. 9, the ink-jet printer 10 according to Embodiment 3 has the same basic configuration as that of the ink-jet printer 10 according to Embodiment 1, and includes a plurality of print heads 2 arranged in the transport direction (the direction from the left side toward the right side in FIG. 8 and FIG. 9, i.e., in a first direction) of the recording medium 100. The ink-jet printer 10 according to Embodiment 3 further includes a press roller 401 arranged above the front surface (front surface on the print head 2 side) of the platen plate 4 between the print heads 2 adjacent to each other in the transport direction of the recording medium 100, the press roller 401 rotating while pressing the floating of the recording medium 100 between the press roller 401 and the front surface of the platen plate 4. The press roller 401 is not arranged directly under the suction hole 42 of the platen plate 4.

Figure 11:
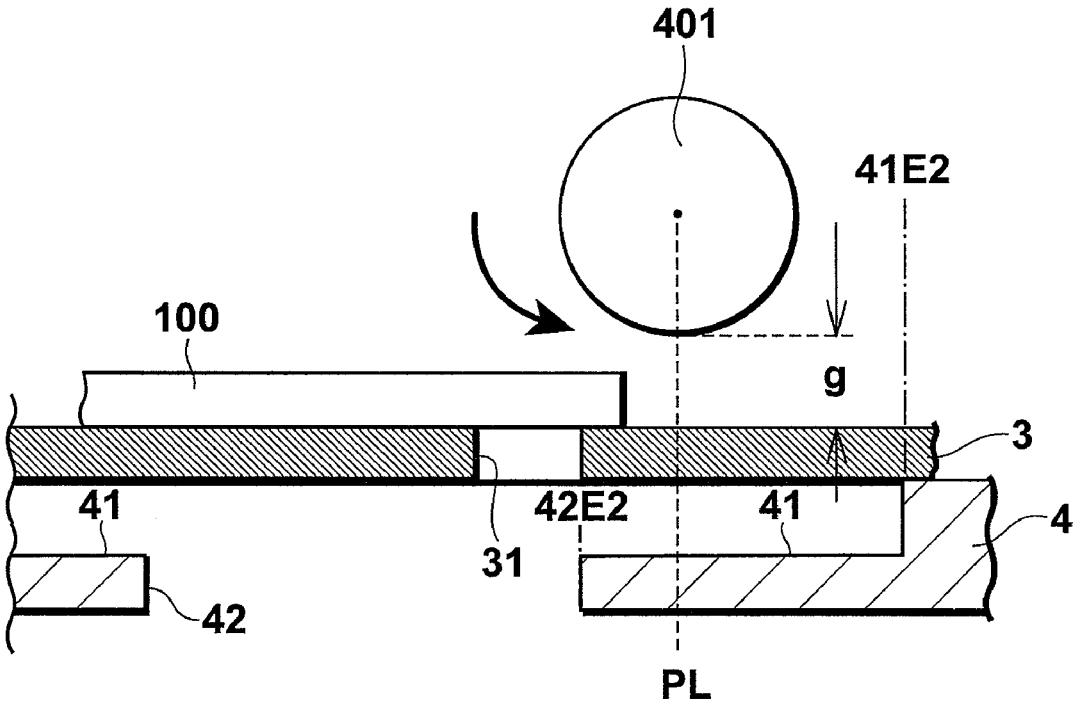
FIG. 11 is a more detailed enlarged sectional view of the main part of the image formation section of the ink-jet printer shown in FIG. 8.

The press roller 401 is arranged in an area immediately before an area where the recording medium 100 is transported to each of a plurality of print heads 2, i.e., on the upstream side in the transport direction of the print head 2. The press roller 401 is arranged via the transport belt 3 above the front surface of the platen plate 4. As shown in FIG. 8 and FIG. 11, the front surface (roller surface) closest to the platen plate 4 side of the press roller 401 is arranged with a certain gap g from the front surface of the transport belt 3. By setting the gap g, the recording medium 100 can be passed between the press roller 401 and the transport belt 3, and a floating generated by curling or the like in the recording medium 100 can be pressed using the press roller 401, and the interference between the recording medium 100 and the print head 2 can be prevented. Here, the gap g is set to, for example, 0.3 mm to 0.7 mm, preferably 0.5 mm.

The press roller 401 is formed into a cylindrical shape having a circular cross section as shown in FIG. 8, the cylindrical shape being elongated in the direction intersecting with the transport direction (in a second direction) and having a certain diameter in the transport direction as shown in FIG. 9. The diameter of the press roller 401 is set in the range of 3.5 mm to 5.0 mm, for example, and thus the press roller 401 is miniaturized. In Embodiment 3, the press roller 401 having the diameter of 3.8 mm or 4.8 mm is used. Here, along a plurality of print heads 2 arranged in the direction intersecting with the transport direction, i.e., from one end of the platen plate 4 in the width direction (the second direction) through the other end, one press roller 401 is arranged, and a plurality of press rollers 401 is arranged in the transport direction.

Figure 10:
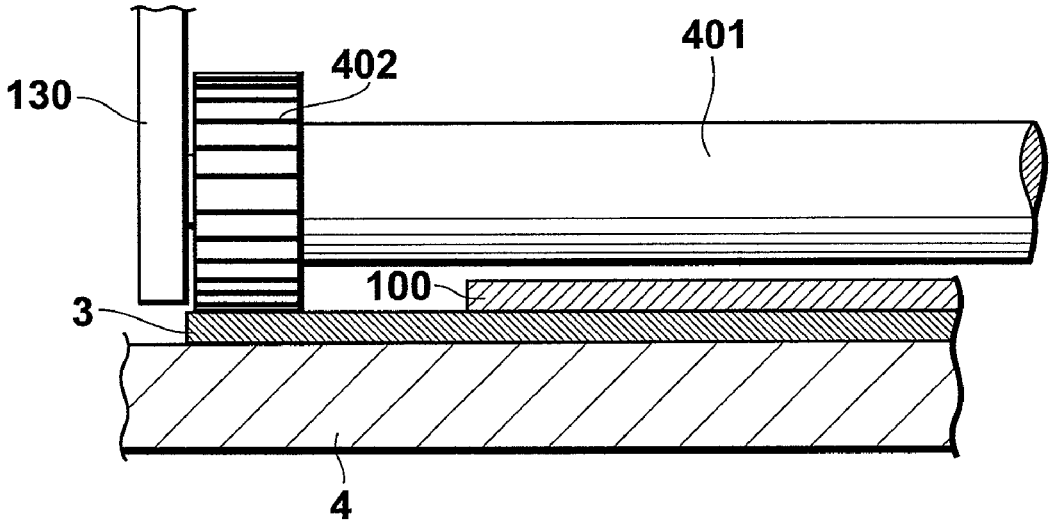
FIG. 10 is an enlarged sectional view of a main part showing a press roller and its drive mechanism of the image formation section of the ink-jet printer shown in FIG. 8.

As shown in FIG. 10, a dependent rotating roller 402 is attached to at least one end of the press roller 401, and the press roller 401 and the dependent rotating roller 402 are rotatably attached to the housing 130 of the ink-jet printer 10. The press roller 401 is formed from, for example, a metal cylinder, a resin cylinder, or the like. The dependent rotating roller 402 is formed from, for example, a rubber roller, a resin roller, or the like, and is mechanically fixed to the press roller 401 using a screw or the like, or is fastened and attached to the press roller 401 using its own elasticity. At least one end of the transport belt 3 in the width direction, the dependent rotating roller 402 is in contact with the front surface of the transport belt 3 with an appropriate pressure (frictional force), and rotates with a movement of the transport belt 3 in the transport direction. This rotation of the dependent rotating roller 402 is transmitted to the press roller 401, which rotates with the rotation of the dependent rotating roller 402.

As shown in FIG. 8, FIG. 9, and FIG. 11, the suction hole 42 of the platen plate 4 for sucking the recording medium 100 to the front surface of the transport belt 3 is not arranged directly under the press roller 401 as described above, but is arranged in an area immediately before an area where the recording medium 100 to be transported is pressed using the press roller 401. That is, the suction hole 42 is arranged on the upstream side of the press roller 401 in the transport direction. The recess 41 is arranged in an area directly under the press roller 401, the area overlapping with the press roller 401.

Here, precisely speaking, "directly under the press roller 401" is used in the sense of "on a center line (imaginary line for the purpose of description) PL vertically drawn from the axial center of the press roller 401 to the front surface of the platen plate 4". Accordingly, with respect to the center line PL, the opening end (second opening end) 42E2 of the suction hole 42 on the most downstream side in the transport direction is arranged in a position shifting to the upstream side in the transport direction. Moreover, the center line PL is present between the opening end (first opening end) 41E2 of the recess 41 on the most downstream side in the transport direction and the opening end 42E2 (second opening end) of the suction hole 42 on the most downstream side in the transport direction.

Moreover, the suction hole 42, as shown in FIG. 9, is arranged in an area on the upstream side of the press roller 401 in the transport direction, the area overlapping with the print head 2 (directly under the print head 2 excluding the ink-discharging nozzles 21 and 22), but is essentially not arranged in the non-suction area 45. In Embodiment 3, in a part of the non-suction area 45 of the press roller 401 on the upstream side in the transport direction, i.e., immediately before the press roller 401 in the non-suction area 45, along the press roller 401, an auxiliary suction hole 42R having the same function as the suction hole 42 is arranged. The auxiliary suction hole 42R is formed into the same planar shape, the same cross-sectional structure, and the same size as those of the suction hole 42, here, and only one row of auxiliary suction holes 42R is arranged along and immediately before the press roller 401.

The press roller 401 according to Embodiment 3 is arranged for the purpose of preventing the floating of the recording medium 100 and preventing the interference between the recording medium 100 and the print head 2, as described above. The gap g set between the press roller 401 and the transport belt 3 is an extremely small space, and when the suction hole 42 is arranged directly under the press roller 401, the air flow associated with the suction of the recording medium 100 becomes fast, resulting in the occurrence of the mist of an ink drop or the occurrence of contamination of the recording medium 100 or the contamination inside the device. Accordingly, by arranging the recess 41 but not arranging the suction hole 42 directly under the press roller 401, the air flow associated with the suction of the recording medium 100 can be slowed and the occurrence of the mist of an ink drop and the occurrence of contamination of the recording medium 100 or the contamination inside the device can be prevented. Moreover, directly under the press roller 401, although the air flow associated with the suction of the recording medium 100 becomes slow, the suction is performed and thus the recording medium 100 can be reliably stuck to the front surface of the transport belt 3.

The suction hole 42 is arranged not directly under the press roller 401 but in a position shifting to the upstream side in the transport direction, in an area immediately before the recording medium 100 is transported to the area directly under the press roller 401. Therefore, the front end of the recording medium 100 in the transport direction, immediately before being transported to the press roller 401, is sucked by the suction device 5 through the punch hole 31 and suction hole 42 (the first suction passage), and is reliably stuck to the front surface of the transport belt 3. In this state, if a floating is occurring even using the press roller 401, the recording medium 100 presses this floating and at the same time is sucked by the suction device 5 through the punch hole 31, recess 41, and suction hole 42 (the second suction passage), and is then transported to the area under the print head 2 without interfering with the print head 2 while being reliably stuck to the front surface of the transport belt 3. On the recording medium 100 transported to the area under the print head 2, printing is performed.

Furthermore, since the front end of the recording medium 100 in the transport direction can be reliably stuck to the front surface of the transport belt 3 immediately before being transported to the press roller 401, the miniaturization of the press roller 401 can be achieved. Usually, in designing the press roller, if an ordinary recording paper is used for the recording medium 100, the floating of the front end of the recording paper in the transport direction from the front surface of the transport belt 3 is set to 3 mm at the maximum, and the size (3.0 mm-0.5 mm) resulting from subtracting the above-described gap g (e.g., 0.5 mm) from this size (=3 mm) is the radius (=2.5 mm) of the press roller. Therefore, the diameter of the press roller is not less than 5.0 mm. Moreover, if an ordinary envelope is used for the recording medium 100, the floating of the front end of the envelope in the transport direction from the front surface of the transport belt 3 is set to 4 mm at the maximum, and the size (4.0 mm-0.5 mm) resulting from subtracting the above-described gap g (e.g., 0.5 mm) from this size (=4 mm) is the radius (=3.5 mm) of the press roller. Therefore, the diameter of the press roller is not less than 7.0 mm. In contrast to such a general design approach of the press roller, the press roller 401 according to Embodiment 3 does not need to consider the floating of the front end of the recording medium 100 in the transport direction, and therefore the diameter of the press roller 401 can be set to less than 5.0 mm as described above.

Since the miniaturization of the press roller 401 can be achieved, the miniaturization of the drive mechanism including the press roller 401 can be achieved. Furthermore, since the arrangement pitch of the print heads 2 in the transport direction can be reduced (print heads 2 can be densely arranged), the print image quality itself can be improved.

Features of Embodiment 3

As described above, in the ink-jet printer 10 according to Embodiment 3, since the image formation section includes the press roller 401, the floating of the recording medium 100 in the area immediately before the upstream side of the print head 2 in the transport direction can be prevented and the interference between the print head 2 and the recording medium 100 can be prevented. Furthermore, in the ink-jet printer 10, since the suction hole 42 of the platen plate 4 is not arranged directly under the press roller 401, the air flow associated with the suction of the recording medium 100 directly under the press roller 401 can be slowed, the occurrence of the mist of an ink discharged from the ink-discharging nozzles 21 and 22 of the print head 2 can be suppressed and the contamination of the recording medium 100 or the contamination inside the device can be prevented.

Furthermore, since the ink-jet printer 10 includes the press roller 401 and also includes the suction hole 42 in a position shilling to the upstream side of the suction hole 42 in the transport direction, not directly under the press roller 401, the front end of the recording medium 100 in the transport direction can be reliably stuck to the front surface of the transport belt 3, and the head gap between the front surface of the recording medium 100 and the nozzle face 20 of the print head 2 can be stably secured. In addition, in the ink-jet printer 10, because the miniaturization of the press roller 401 can be achieved, the print heads 2 can be densely arranged in the transport direction. Accordingly, in the ink-jet printer 10, the print image quality can be dramatically improved.

Variation

The ink-jet printer 10 according to a variation of Embodiment 3 is an example of further slowing the air flow directly under the press roller 401 in the ink-jet printer 10 according to Embodiment 3.

Figure 12:
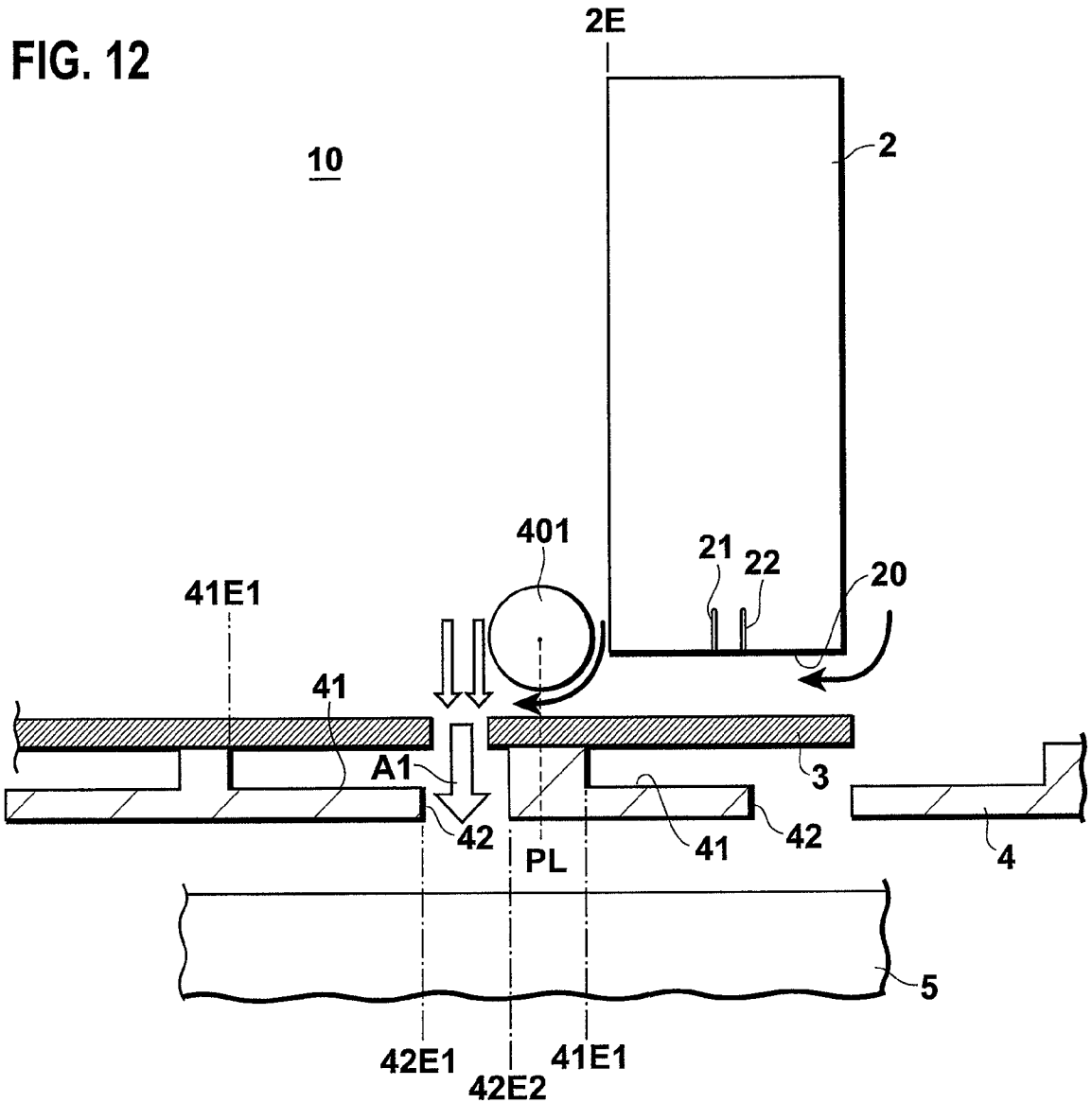
FIG. 12 is an enlarged sectional view of a main part of an image formation section of an ink-jet printer according to a variation of Embodiment 3.

As shown in FIG. 12, in the ink-jet printer 10 according to the variation of Embodiment 3, directly under the press roller 401, the suction hole 42 and recess 41 are not arranged in the platen plate 4. The suction hole 42 is arranged in a position shifting from the area directly under the press roller 401 to the upstream side in the transport direction, so that the recess 41 is substantially excluded in the area directly under the press roller 401 and the front surface of the platen plate 4 contacts the back surface of the transport belt 3.

In the ink-jet printer 10 according to the variation configured in this manner, the same operational effect as that of the ink-jet printer 10 according to the above-described Embodiment 3 can be attained, and the suction passage itself is not included directly under the press roller 401. Therefore, when the punch hole 31 of the transport belt 3 overlaps with the area directly under the press roller 401, the air flow associated with the suction of this area is substantially eliminated. Accordingly, the cause of the mist of an ink can be eliminated, so that the contamination of the recording medium 100 or the contamination inside the device can be prevented.

[Embodiment 4]

Embodiment 4 of the present invention is an example capable of preventing, in particular, the floating of a corner of the front end of the recording medium 100 in the transport direction and preventing the interference between the recording medium 100 and the print head 2 in the print operation of the recording medium 100 of a specific standard (size) in the ink-jet printer 10 according to Embodiment 1.

Device Configuration of Ink-jet Printer

Figure 13:
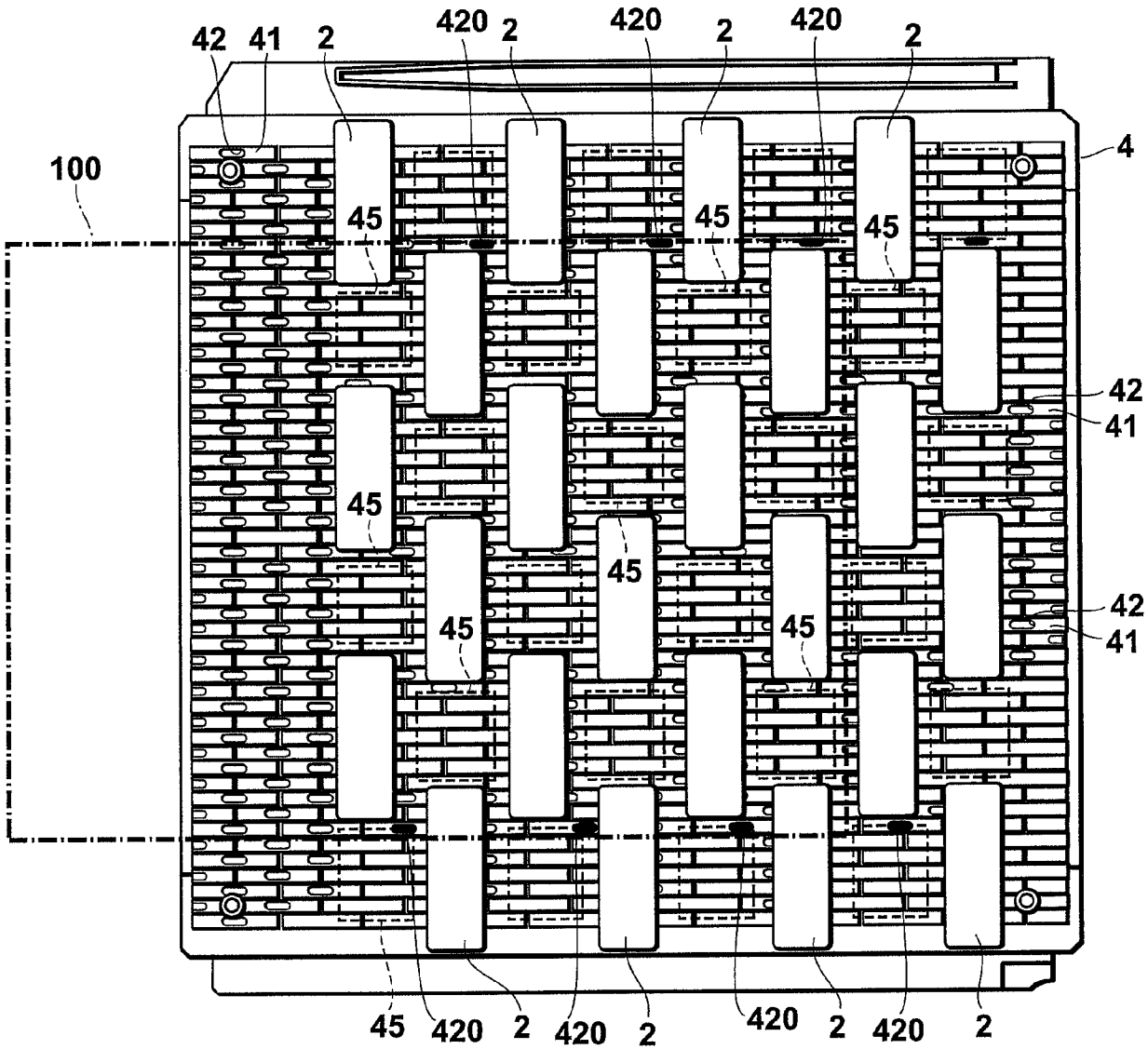
FIG. 13 is a plan view of a main part of an image formation section of an ink-jet printer according to Embodiment 4 of the present invention.
Figure 14:
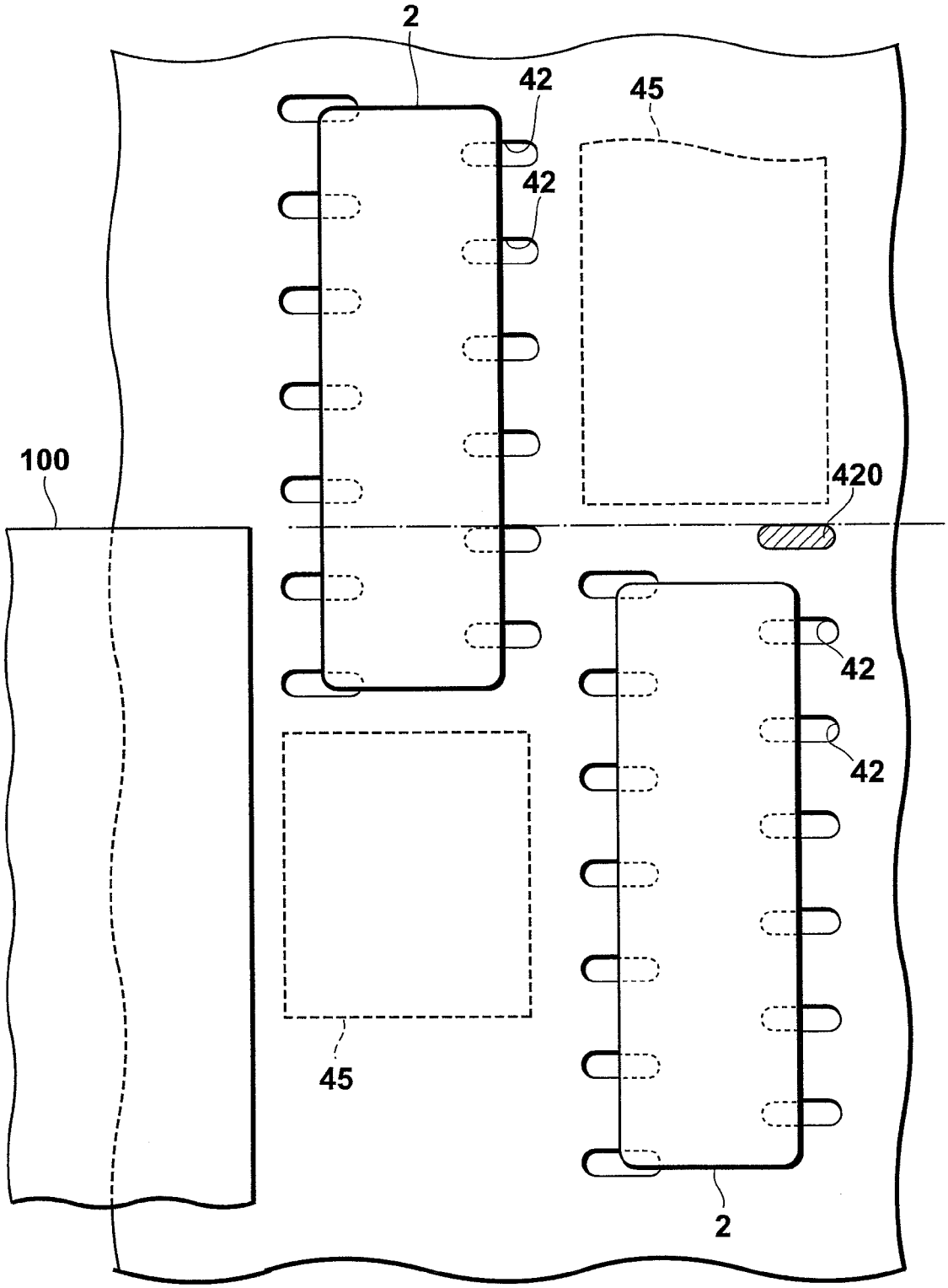
FIG. 14 is an enlarged plan view of the main part of the image formation section of the ink-jet printer shown in FIG. 13.

As shown in FIG. 13 and FIG. 14, the ink-jet printer 10 according to Embodiment 4 includes: a plurality of print heads 2 arranged in the second direction intersecting with the transport direction, the print heads 2 each having the ink-discharging nozzles 21 and 22 in the nozzle face 20; and the platen plate 4 having a plurality of suction holes 42 extending from the front surface on the nozzle face 20 side toward the back surface facing thereto in an area overlapping with the print head 2 and also having the non-suction area 45, in which the arrangement density of the suction holes 42 is smaller than the area overlapping with the print head 2, between the print heads 2 adjacent to each other in the second direction. The ink-jet printer 10 according to Embodiment 4 further includes an auxiliary suction hole 420 extending from the front surface of the platen plate 4 through the back surface between the print head 2 and the non-suction area 45 of the platen plate 4.

The ink-jet printer 10 is manufactured so as to be able to print the recording media 100 having various standard sizes, for example, recording papers having an A5 size, an A4 size, an A3 size, a B5 size, a B4 size, a B3 size, and the like. In the print operation of a recording paper having a specific standard size, for example, a recording paper having the A4 size, in FIG. 13, the upper end of this recording paper passes through the upper outer side of the print heads 2 in the second row, fourth row, sixth row, and eighth row from the left toward right, while the lower end of this recording paper passes through the lower outer side of the print heads 2 in the first row, third row, fifth row, and seventh row from the left toward right. That is, both ends of the recording paper in the second direction intersecting with the transport direction are transported in an area in which the suction hole 42 is not arranged, the area being located outside the print head 2. As described above, if an expansion occurs in the peripheral length of the recording paper with moisture absorption, temperature increase, or the like, the recording paper is likely to float locally, and if, in particular, a corner of the front end of the recording paper in the transport direction floats, the recording paper interferes with the print head 2 to cause a paper jam. In the ink-jet printer 10 according to Embodiment 4, in order to eliminate the cause of such a phenomena, the auxiliary suction hole 420 is arranged at an area where a corner of the front end of the recording medium 100 in the transport direction passes through, i.e., in the area between the print head 2 and the non-suction area 45 (or within the non-suction area 45).

The auxiliary suction hole 420 is basically formed into the same planar shape, the same cross-sectional shape, and the same size as those of the suction hole 42 arranged under the print head 2. Of course, as required, the shape and size of the auxiliary suction hole 420 may differ from those of the suction hole 42. Moreover, here, as shown in FIG. 14, one auxiliary suction hole 420 is arranged between the print head 2 and the non-suction area 45, but not limited to this number, and two or more auxiliary suction holes 420 may be arranged if the suction force is desired to be increased.

Features of Embodiment 4

As described above, in the ink-jet printer 10 according to Embodiment 4, in addition to the operational effect obtained by the ink-jet printer 10 according to the above-described Embodiment 1, the floating of a corner of the front end of the recording medium 100 in the transport direction can be prevented and the interference between the print head 2 and the recording medium 100 can be prevented because the ink-jet printer 10 includes a plurality of print heads 2 arranged in the second direction of the image formation section and the non-suction area 45 arranged between these print heads 2 and further includes the auxiliary suction hole 420 between the print head 2 and the non-suction area 45.

Note that the ink-jet printer 10 according to Embodiment 4 can be combined with the ink-jet printer 10 according to Embodiment 2 or the ink-jet printer 10 according to Embodiment 3.

[Other Embodiments]

As described above, the present invention has been described using Embodiment 1 to Embodiment 4, however, the statements and drawings which are a part of the present disclosure are not to be construed as limiting the present invention. The present invention can be applied to various kinds of alternative embodiments, embodiments, and operation technologies. For example, in the above-described Embodiment 1 to Embodiment 4, the ink-jet printer 10 including two rows of ink-discharging nozzles 21 and 22 in the print head 2 has been described, however, the present invention can be applied to ink-jet printers including a print head having one row or three or more rows of ink-discharging nozzles. In the case of a print head having three or more rows of ink-discharging nozzles, in the present invention at least one row of ink-discharging nozzles is arranged overlapping with the second suction passage in which the air flow is slow.

Moreover, in the present invention, three or more kinds of suction passages in which the speed of the air flow differs (e.g., a first suction passage, a second suction passage, and a third suction passage, and so on in which the suction force decreases in this order) may be arranged.

Furthermore, the present invention can be applied to a complex ink-jet printer having not only a single printer function but a scanner function or a facsimile function.

As described above, according to the present invention, it is possible to provide an ink-jet printer capable of preventing the floating of a recording medium directly under an ink-discharging nozzle while reducing the air flow associated with the suction of the recording medium in an area directly under the ink-discharging nozzle of a print head and in the vicinity of this area, suppressing the generation of the mist of an ink drop, and preventing the contamination of the recording medium or the contamination inside the device.

Furthermore, according to the present invention, it is possible to provide an ink-jet printer capable of preventing the interference between a print head and a recording medium and capable of suppressing degradation in print image quality.

Furthermore, according to the present invention, it is possible to provide an ink-jet printer capable of preventing the interference between a print head and a recording medium by preventing the floating of the recording medium directly under an ink-discharging nozzle, the ink-jet printer being capable of suppressing the occurrence of mist, preventing the contamination of the recording medium or the contamination inside the device, securing a head gap, and suppressing a degradation in the print image quality.

Furthermore, according to the present invention, it is possible to provide an ink-jet printer capable of preventing the interference between a print head and a recording medium by preventing the floating of the recording medium immediately before the upstream side of the print head in the transport direction, the ink-jet printer being capable of preventing the occurrence of mist and suppressing the contamination of the recording medium or the contamination inside the device, securing a head gap, densely arranging the print heads in the transport direction, and suppressing a degradation in the print image quality.

Furthermore, according to the present invention, it is possible to provide an ink-jet printer capable of preventing the interference between a print head and a recording medium by preventing the floating of a corner of the front end of the recording medium in the transport direction, the ink-jet printer being capable of suppressing the occurrence of mist, preventing the contamination of the recording medium or the contamination inside the device, and suppressing a degradation in the print image quality.

Accordingly, the present invention can be applied to an ink-jet printer capable of preventing the floating of a recording medium directly under an ink-discharging nozzle while reducing the air flow associated with the suction of the recording medium directly under the ink-discharging nozzle of a print head and in the vicinity of this area, suppressing the generation of the mist of an ink drop, and preventing contamination of the recording medium or the contamination inside the device.

The present application claims the benefit of priority under 35 U.S.C. §119 to Japanese Patent Applications No. 2010-085405, filed on Apr. 1, 2010, and No. 2010-240993, filed on Oct. 27, 2010, the entire contents of which are incorporated herein by reference.

What is claimed is:

1. An ink-jet printer comprising:

a platen plate including a plurality of suction holes extending from a front surface through a back surface and a recess which is opened toward the front surface around each suction hole; and a plurality of print heads each having an ink-discharging nozzle provided in a nozzle face which is arranged in a position facing the front surface of the platen plate, wherein the ink-discharging nozzle of each of the print heads is arranged in an area overlapping with some of the recesses of the platen plate.

2. The ink-jet printer according to claim 1, wherein a part of a periphery of the nozzle face of each of the print heads is arranged in an area overlapping with some of the suction holes of the platen plate.

3. The ink-jet printer according to claim 1, wherein the ink-discharging nozzle of each of the print heads comprises a plurality of rows of nozzles, and wherein at least one nozzle row among them is arranged in an area avoiding overlap with the suction holes of the platen plate.

4. The ink-jet printer according to claim 1, wherein the recesses of the platen plate comprise a plurality of recess rows formed by alternately arranging a first recess row arranged in a predetermined direction and a second recess row arranged being shifted in a direction intersecting with the predetermined direction by a predetermined pitch with respect to the first recess row, and wherein the ink-discharging nozzle of each of the print heads comprises a plurality of nozzle rows arranged in a direction intersecting with the predetermined direction.

5. The ink-jet printer according to claim 1, further comprising a plurality of press rollers arranged above the front surface of the platen plate between adjacent print heads of the print heads, the press rollers rotating while pressing a floating of a recording medium between the press roller and the front surface of the platen plate, wherein each of the press rollers is arranged in an area avoiding overlap with the suction holes of the platen plate.

6. The ink-jet printer according to claim 5, wherein some of the suction holes of the platen plate are arranged in an area immediately before an area where the recording medium is pressed using the press rollers.

7. The ink-jet printer according to claim 6, wherein each of the press rollers is arranged in an area overlapping with some of the recesses of the platen plate.

8. The ink-jet printer according to claim 5, wherein each of the press rollers is arranged in an area on an upstream side in a transport direction of the recording medium of the recesses of the platen plate.

9. The ink-jet printer according to claim 5, wherein each of the press rollers is arranged in an area avoiding the recesses of the platen plate.

10. The ink-jet printer according to claim 1, wherein the platen plate includes a suction area in which an arrangement density of suction holes is lower than that in an area overlapping with each of the print heads, between adjacent print heads of the print heads, and wherein the suction area includes an auxiliary suction hole for adjusting the arrangement density.

11. An ink-jet printer comprising:

a platen plate including a plurality of first suction passages extending from a front surface through a back surface and a plurality of second suction passages extending from the front surface through the back surface, the second suction passage having a small suction force as compared with that of the first suction passage; and a plurality of print heads each having an ink-discharging nozzle provided in a nozzle face which is arranged in a position facing the front surface of the platen plate, wherein the ink-discharging nozzle of each of the print heads is arranged in a position facing some of the second suction passages of the platen plate, and wherein a part of a periphery of the nozzle face of each of the print heads is arranged in a position facing some of the first suction passages of the platen plate.

* * * * *